US006627008B1

(12) United States Patent
Taniguchi et al.

(10) Patent No.: US 6,627,008 B1
(45) Date of Patent: Sep. 30, 2003

(54) GROOVED SUBSTRATES FOR MULTIFIBER OPTICAL CONNECTORS AND FOR ALIGNMENT OF MULTIPLE OPTICAL FIBERS AND METHOD FOR PRODUCTION THEREOF

(75) Inventors: Takeshi Taniguchi, Sendai (JP); Toshio Arai, Miyagi-ken (JP); Junichi Nagahora, Sendai (JP)

(73) Assignees: YKK Corporation, Tokyo (JP); NTT Advanced Technology Corporation, Tokyo (JP)

( * ) Notice: Subject to any disclaimer, the term of this patent is extended or adjusted under 35 U.S.C. 154(b) by 0 days.

(21) Appl. No.: 09/566,131

(22) Filed: May 5, 2000

(30) Foreign Application Priority Data

May 6, 1999 (JP) ..... 11-125593

(51) Int. Cl.[7] ..... C22C 45/10
(52) U.S. Cl. ..... 148/403; 385/137
(58) Field of Search ..... 428/600; 420/205, 420/252, 266; 148/403, 561; 385/136, 137, 140, 78, 60–68

(56) References Cited

U.S. PATENT DOCUMENTS

| | | | | |
|---|---|---|---|---|
| 3,403,238 A | | 9/1968 | Buehler et al. | |
| 4,261,644 A | | 4/1981 | Giannaris | |
| 4,456,713 A | | 6/1984 | French et al. | |
| 4,597,632 A | | 7/1986 | Mallinson | |
| 4,753,902 A | | 6/1988 | Ketcham | |
| 4,762,678 A | | 8/1988 | Dolgin | |
| 4,797,236 A | | 1/1989 | Kojima | |
| 4,850,664 A | | 7/1989 | Iri et al. | |
| 4,850,671 A | * | 7/1989 | Finzel | 385/69 |
| 5,015,617 A | | 5/1991 | Ohata et al. | |
| 5,032,196 A | | 7/1991 | Masumoto et al. | |
| 5,112,781 A | | 5/1992 | Jada | |
| 5,213,148 A | | 5/1993 | Masumoto et al. | |
| 5,222,169 A | | 6/1993 | Chang et al. | |

(List continued on next page.)

FOREIGN PATENT DOCUMENTS

| | | |
|---|---|---|
| EP | 0 112 072 | 6/1984 |
| GB | 1 448 975 | 9/1976 |
| JP | 1-45042 | 10/1989 |
| JP | 5-134146 | 5/1993 |
| JP | 7-174937 | 7/1993 |
| JP | 6-82656 | 3/1994 |
| JP | 7-181338 | 7/1995 |

OTHER PUBLICATIONS

K. Ikuta, H. Fujita, M. Ikeda, S. Yamashita, "Crystallographic Analysis of TiNi Shape Memory Alloy Thin Film for Micro Actuator," Proceedings, IEEE Micro Electric Mechanical Systems, CA, USA, Feb. 11–14, 1990, pp. 38–39, XP002108161.

EPO Search Report dated Sep. 9, 1999, EP Application No. 97 12 2402.

*Primary Examiner*—George Wyszomierski
(74) *Attorney, Agent, or Firm*—Finnegan, Henderson, Farabow, Garrett & Dunner, L.L.P.

(57) ABSTRACT

A grooved substrate which has a groove for aligning or positioning an optical fiber therein and which can be advantageously used in a multifiber optical connector or for aligning a multiple optical fiber is formed of an amorphous alloy possessing at least a glass transition region, preferably a glass transition region of not less than 30 K in temperature width. Particularly, the amorphous alloy of $M^1$—$M^2$ system or $M^1$—$M^2$—La system ($M^1$: Zr and/or Hf, $M^2$: Ni, Cu, Fe, Co, Mn, Nb, Ti, V, Cr, Zn, Al, and/or Ga, La: rare earth element) possesses a wide range of $\Delta Tx$ and thus can be advantageously used as a material for the grooved substrate. Such a grooved substrate can be manufactured with high mass-productivity by a metal mold casting method or molding method.

9 Claims, 7 Drawing Sheets

U.S. PATENT DOCUMENTS 5,316,711 A 5/1994 Throne
5,482,451 A 1/1996 Johnson et al.
5,615,291 A 3/1997 Hayakawa et al.
5,618,359 A * 4/1997 Lin et al. ..... 148/403
5,631,986 A 5/1997 Frey et al.
5,797,443 A * 8/1998 Lin et al. ..... 148/403
5,862,280 A 1/1999 Tanaka et al.
5,896,642 A * 4/1999 Peker et al. ..... 148/561
6,010,580 A * 1/2000 Dandliker et al. ..... 148/403
6,158,900 A * 12/2000 Omiya et al. ..... 385/78
6,213,649 B1 * 4/2001 Omiya et al. ..... 385/60
6,435,731 B1 * 8/2002 Yamaguchi et al. ..... 385/78
2002/0031310 A1 * 3/2002 Kobayashi et al. ..... 385/70

* cited by examiner

GROOVED SUBSTRATES FOR MULTIFIBER OPTICAL CONNECTORS AND FOR ALIGNMENT OF MULTIPLE OPTICAL FIBERS AND METHOD FOR PRODUCTION THEREOF

BACKGROUND OF THE INVENTION

1. Field of the Invention

This invention relates to grooved substrates for positioning and retaining optical fibers to be used in optical communications, and more particularly to the grooved substrates for use in multifiber optical connectors which can realize coupling of the connectors by using guide pins or the grooved substrates for aligning the multiple optical fibers, which substrate is capable of positioning and retaining the optical fibers therein. This invention also relates to methods for the production thereof.

2. Description of the Prior Art

As an optical connector to be used for connecting the optical fibers to each other, heretofore, the fitting type optical connector as shown in FIGS. 1 and 2, for example, is known in the art. The multifiber optical connector 10*a* (in the example shown in the drawings, four-fiber optical connector) is basically composed of a V-grooved substrate 11 and a retaining substrate 14 fixed to the V-grooved substrate 11 through the medium of an adhesive. The V-grooved substrate 11 is provided with a plurality of V-grooves 12 for optical fibers formed therein parallel to each other, each groove having a cross-sectional contour of the letter V, and V-grooves 13 for guide pins formed on the opposite side of the V-grooves 12. By joining the retaining substrate 14 to the V-grooved substrate 11, the holes for optical fibers and those for guide pins are respectively formed by the V-grooves 12 for optical fibers and the V-grooves 13 for guide pins in the joining area thereof. The multifiber optical connector 10*a* is prepared by inserting and adhering the optical fibers 16 into the holes for optical fibers and polishing the end face of the assembled connector. Another multifiber optical connector 10*b* is similarly provided with a plurality of holes for optical fibers into which the optical fibers 16 are inserted and adhered, but has guide pins 15 projected at the positions aligned with the V-grooves 13 for guide pins mentioned above. The mutual coupling of the optical connectors 10*a*, 10*b* is performed by inserting the guide pins 15 into the holes for guide pins mentioned above. The reference numeral 17 denotes a fiber tape.

The V-grooved substrate for aligning multiple optical fibers is also used in a mechanical splice for abutting, the optical fibers against each other and joining them by fusion thereof or through the medium of an agent for adjusting the refractive index, to align and retain the optical fibers therein. FIGS. 3 and 4 illustrate an example of the four-fiber mechanical splice. The mechanical splice 20 is composed of a V-grooved substrate 21 having V-grooves 22 formed therein for positioning the optical fibers 16, a retaining substrate 25, and a clamp spring 28 of the snap-in fitting type capable of exerting the holding power to clamp them. The V-grooved substrate 1 is provided with guide grooves 24 respectively formed at opposite ends of the parallel V-grooves 22 and wedge guide grooves 23 of a prescribed number (four, in the example shown in the drawing) at one longitudinal edge. Similarly, the retaining substrate 25 is provided with wedge guide grooves 26 formed therein at the position aligned with the wedge guide grooves 23 mentioned above. Each wedge insertion hole 27 is formed by a pair of upper and lower wedge guide grooves 23 and 26. The attachment of the optical fibers 16 to the mechanical splice 20 is performed by inserting wedges 29 into the wedge insertion holes 27 mentioned above to form a gap between the substrates 21 and 25, inserting the optical fibers 16 into the gap from opposite ends so as to abut the ends of the optical fibers against each other, and pulling the wedges 29 out of the holes 27 thereby allowing the upper and lower substrates 21 and 25 to be clamped with the clamp spring 28 and establishing the connection of the optical fibers.

As the materials for the V-grooved substrates, heretofore, a wafer of silicon single crystal as disclosed in published Japanese Patent Application, KOKAI (Early Publication) No. (hereinafter referred to briefly as "JP-A-") 6-82656 and JP-A-5-134146, alumina, or a glass filler-containing epoxy :resin as disclosed in JP-A7-181338 is used. The V-grooves are formed by the anisotropic etching of silicon when the wafer of silicon single crystal is used as the substrate material or by the grinding process when alumina is used. In the case of an epoxy resin, the V-grooved substrate is manufactured by the injection molding.

SUMMARY OF THE INVENTION

In the manufacture of the V-grooved substrates for multifiber optical connectors, it is very important to minimize the clearance between the guide pin and the guide pin hole as possible, without mentioning that the positioning of the optical fiber holes to the guide pin holes and the mutual distance between the optical fiber holes should be adjusted in the submicron order.

When a wafer of silicon single crystal is used as a substrate material, the V-grooves are formed by the anisotropic etching of silicon as mentioned above. However, this processing is expensive. Further, the guide pin holes entail such problems as wear and micro-deformation thereof when the guide pins are frequently attached to and detached from the guide pin holes of the above substrate, which increases the clearance between the guide pin and the guide pin hole and eventually results in the deviation from the mutual alignment of the optical fibers. As a result, it will be difficult to connect the optical fibers stably with a low connector insertion loss.

When the substrate material is alumina, it takes a longer time for forming V-grooves. In addition thereto, since it needs the grinding process with high processing cost, the V-grooved substrate obtained will be inevitably expensive.

On the other hand, when the V-grooved substrate is manufactured from an epoxy resin, it can be produced by the injection molding at a low cost. It poses, however, a serious problem of the increase in the clearance between the guide pin and the guide pin hole with the repeated attachment and detachment of the guide pin to and from the hole, as in the case of the substrate made from the wafer of silicon single crystal.

As described above, heretofore, it is not possible to manufacture the grooved substrate that allows the multifiber optical connector to stably maintain the low connector insertion loss (no increase in the clearance between the guide pin and the guide pin hole) at a low cost from the conventional materials such as the wafer of silicon single crystal, alumina, and epoxy resins.

The grooved substrate for aligning multiple optical fibers is also required to possess the mechanical strength, wear resistance, and other properties because wedges are used to release the clamping action.

It is, therefore, an object of the present invention to provide an inexpensive grooved substrate which possesses a sufficient strength, incurs only sparingly such problems mentioned above as causing wear and micro-deformation by the repeated attachment and detachment of the guide pins or the wedges and allows an optical connector prepared by using this grooved substrate to maintain the stable low connector insertion loss.

A further object of the present invention is to provide a method which, owing to the combination of a technique based on the conventional metal mold casting process or molding process with the quality of an amorphous alloy exhibiting a glass transition region, allows a grooved substrate satisfying a predetermined shape, dimensional accuracy, and surface quality to be mass-produced with high efficiency by a simple process and, therefore, enables to omit or diminish markedly such machining steps as grinding and consequently provide an inexpensive grooved substrate excelling in durability, strength, resistance to impact, resistance to wear, elasticity, etc. expected of the grooved substrate.

To accomplish the object mentioned above, the first aspect of the present invention provides a grooved substrate for positioning and retaining optical fibers, particularly a grooved substrate for use in a multifiber optical connector which realizes coupling of the connectors by using guide pins or a grooved substrate for aligning and retaining the optical fibers, which is characterized by being manufactured from an amorphous alloy instead of a wafer of silicon single crystal, alumina, or an epoxy resin which has been heretofore used. The groove may have the cross-sectional contour of substantially the Letter V, as in the conventional V-grooved substrate, or substantially the letter U.

The first embodiment of the grooved substrate according to the present invention is characterized by being manufactured from an amorphous alloy possessing at least a glass transition region, preferably a glass transition region of a temperature width of not less than 30 K.

In a preferred embodiment, the grooved substrate is characterized by being formed of a substantially amorphous alloy having a composition represented by either one of the following general formulas (1) to (6) and containing an amorphous phase in a volumetric ratio of at least 50%:

$$M^1_a M^2_b Ln_c M^3_d M^4_e M^5_f \quad (1)$$

wherein $M^1$ represents either or both of the two elements, Zr and Hf; $M^2$ represents at least one element selected from the group consisting of Ni, Cu, Fe, Co, Mn, Nb, Ti, V, Cr, Zn, Al, and Ga; Ln represents at least one element selected from the group consisting of Y, La, Ce, Nd, Sm, Gd, Tb, Dy, Ho, Yb, and Mm (mish metal: aggregate of rare earth elements); $M^3$ represents at least one element selected from the group consisting of Be, B, C, N, and O; $M^4$ represents at least one element selected from the group consisting of Ta, W, and Mo; $M^5$ represents at least one element selected from the group consisting of Au, Pt, Pd, and Ag; and a, b, c, d, e, and f represent such atomic percentages as respectively satisfy $25 \leqq a \leqq 85, 15 \leqq b \leqq 75, 0 \leqq c \leqq 30, 0 \leqq d \leqq 30, 0 \leqq e \leqq 15$, and $0 \leqq f \leqq 15$.

$$Al_{100-g-h-i} Ln_g M^6_h M^3_i \quad (2)$$

wherein Ln represents at least one element selected from the group consisting of Y, La, Ce, Nd, Sm, Gd, Tb, Dy, Ho, Yb, and Mm; $M^6$ represents at least one element selected from the group consisting of Ti, V, Cr, Mn, Fe, Co, Ni, Cu, Zr, Nb, Mo, Hf, Ta, and W; $M^3$ represents at least one element selected from the group consisting of Be, B, C, N, and O; and g, h, and i represent such atomic percentages as respectively satisfy $30 \leqq g \leqq 90, 0 \leqq h \leqq 55$, and $0 \leqq i \leqq 10$.

$$Mg_{100-p} M^7_p \quad (3)$$

wherein $M^7$ represents at least one element selected from the group consisting of Cu, Ni, Sn, and Zn; and p represents an atomic percentage falling in the range of $5 \leqq p \leqq 60$.

$$Mg_{100-q-r} M^7_g M^8_r \quad (4)$$

wherein $M^7$ represents at least one element selected from the group consisting of Cu, Ni, Sn, and Zn; $M^8$ represents at least one element selected from the group consisting of Al, Si, and Ca; and q and r represent such atomic percentages as respectively satisfy $1 \leqq q \leqq 35$ and $1 \leqq r \leqq 25$.

$$Mg_{100-q-s} M^7_q M^9_s \quad (5)$$

wherein $M^7$ represents at least one element selected from the group consisting of Cu, Ni, Sn, and Zn; $M^9$ represents at least one element selected from the group consisting of Y, La, Ce, Nd, Sm, and Mm; and q and s represent such atomic percentages as respectively satisfy $1 \leqq q \leqq 35$ and $3 \leqq s \leqq 25$.

$$Mg_{100-q-r-s} M^7_q M^8_r M^9_s \quad (6)$$

wherein $M^7$ represents at least one element selected from the group consisting of Cu, Ni, Sn, and Zn; $M^8$ represents at least one element selected from the group consisting of Al, Si, and Ca; $M^9$ represents at least one element selected from the group consisting of Y, La, Ce, Nd, Sm, and Mm; and q, r, and s represent such atomic percentages as respectively satisfy $1 \leqq q \leqq 35, 1 \leqq r \leqq 25$, and $3 \leqq s \leqq 25$.

The second aspect of the present invention provides methods for the production of the grooved substrates as mentioned above.

One mode of the methods is characterized by comprising the steps of melting an alloying material capable of producing an amorphous alloy in a melting vessel having an upper open end, forcibly transferring the resultant molten alloy into a forced cooling casting mold disposed above the vessel and provided with at least one molding cavity, and rapidly solidifying the molten alloy in the forced cooling casting mold to confer amorphousness on the alloy thereby obtaining the product made of an alloy containing an amorphous phase.

In a preferred embodiment of this method, the melting vessel is furnished therein with a molten metal transferring member adapted to forcibly transfer the molten alloy upward, the forced cooling casting mold is provided with at least two identically shaped molding cavities and runners severally communicating with the cavities, and the runners are disposed on an extended line of a transfer line for the molten metal transferring member.

Another method is characterized by comprising the steps of providing a vessel for melting and retaining an alloying material capable of producing an amorphous alloy possessing a glass transition region, providing a metal mold provided with at least one cavity of the shape of the product aimed at, coupling a hole formed in, for example, the lower or upper part of the vessel with a sprue of the metal mold, for example by disposing the metal mold beneath or on the vessel, applying pressure on a melt of the alloy in the vessel thereby enabling a prescribed amount of the melt to pass through the hole of the vessel and fill the cavity of the metal mold, and solidifying the melt in the metal mold at a cooling rate of not less than 10 K(Kelvin scale)/sec. thereby giving rise to the product of an alloy containing an amorphous phase.

In any of the methods described above, as the alloying material mentioned above, a material capable of producing a substantially amorphous alloy having a composition represented by either one of the aforementioned general formulas (1) to (6) and containing an amorphous phase in a volumetric ratio of at least 50% is advantageously used.

Still another method of the present invention is characterized by comprising the steps of heating a material formed of a substantially amorphous alloy having a composition represented by either one of the general formulas (1) to (6) mentioned above and containing an amorphous phase in a volumetric ratio of at least 50% until the temperature of a supercooled liquid region, inserting the resultant hot amorphous material into a container held at the same temperature, coupling with the container a metal mold provided with a cavity of the shape of the product aimed at, and forcing a prescribed amount of the alloy in the state of a supercooled liquid into the metal mold by virtue of the viscous flow thereof.

BRIEF DESCRIPTION OF THE DRAWINGS

Other objects, features, and advantages of the invention will become apparent from the following description taken together with the drawings, in which.

DETAILED DESCRIPTION OF THE PREFERRED EMBODIMENTS

Figure 1:
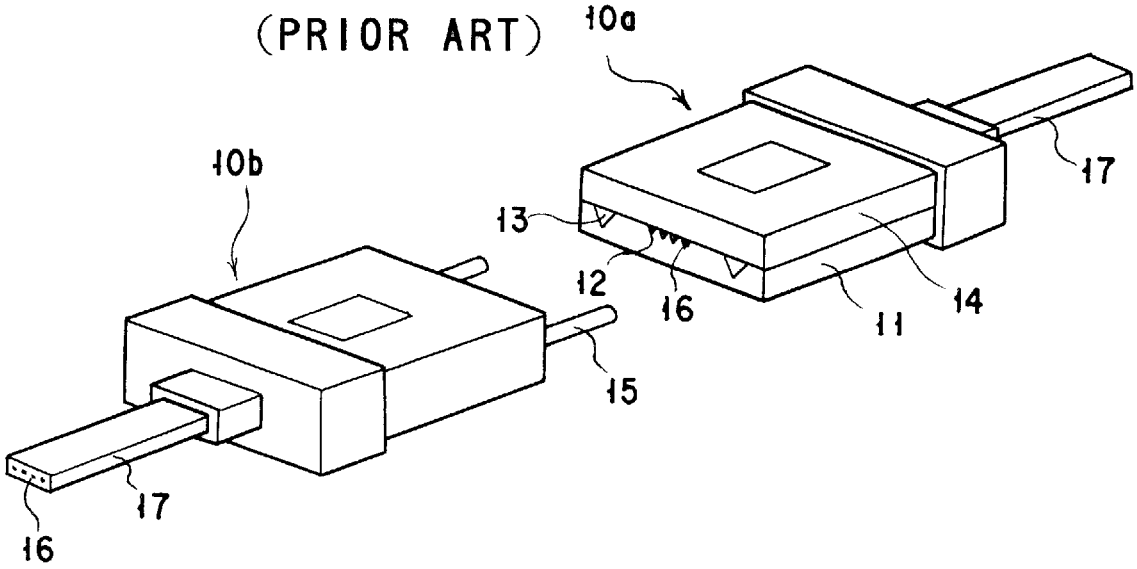
FIG. 1 (PRIOR ART)
FIG. 1 is a perspective view of a conventional multifiber optical connector.
Figure 2:
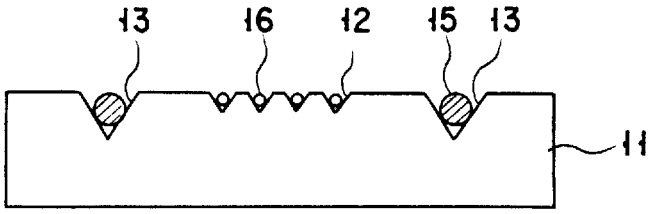
FIG. 2 (PRIOR ART)
FIG. 2 is a partially cross-sectioned side view of the V-grooved substrate used in the multifiber optical connector shown in FIG. 1.
Figure 3:
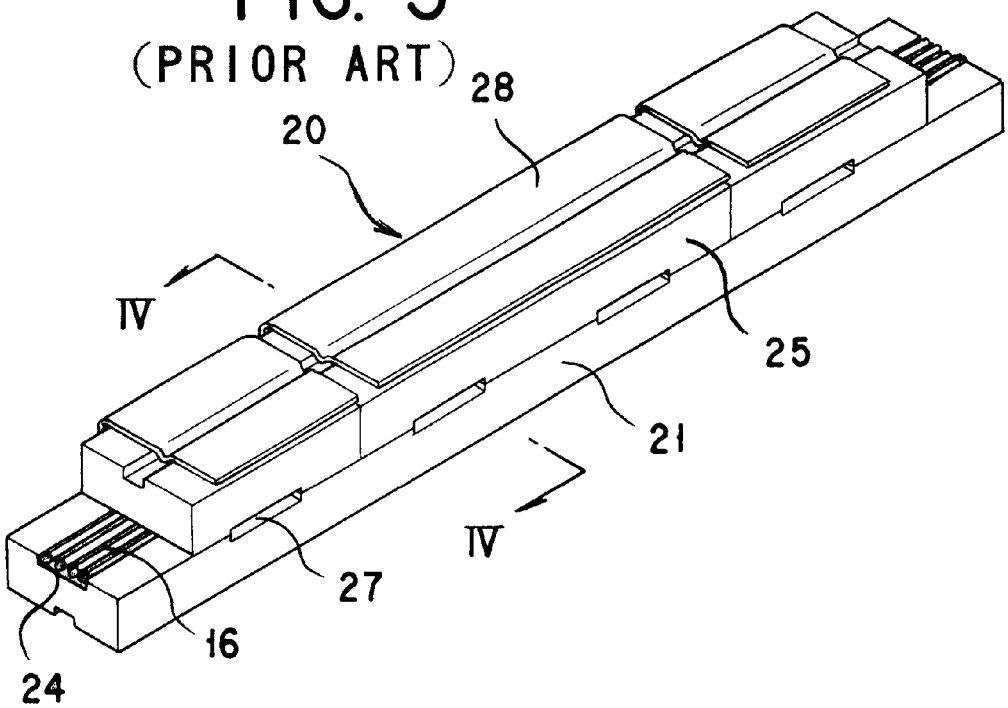
FIG. 3 (PRIOR ART)
FIG. 3 is a perspective view of a conventional mechanical splice.
Figure 4:
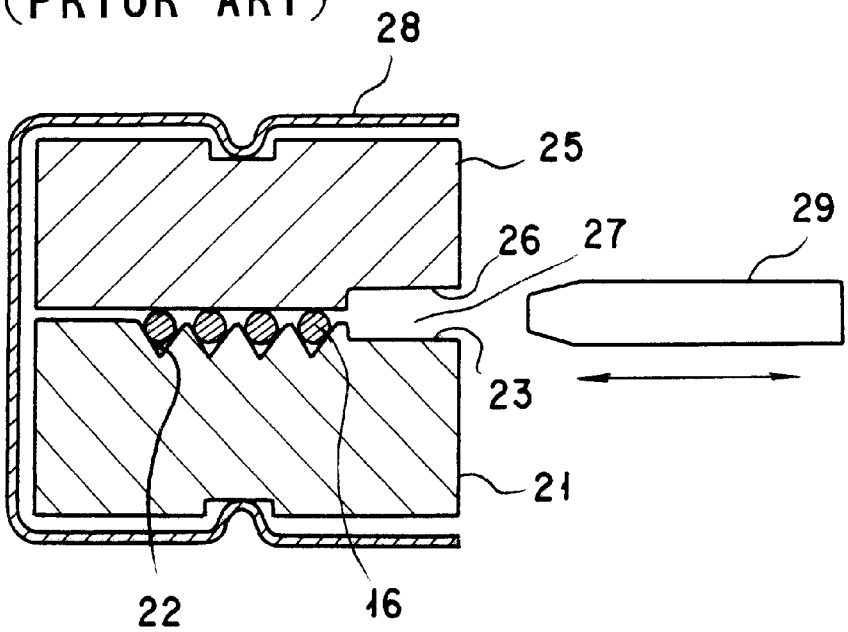
FIG. 4 (PRIOR ART)
FIG. 4 is a cross-sectional view taken through FIG. 3 along the line IV—IV.
Figure 5:
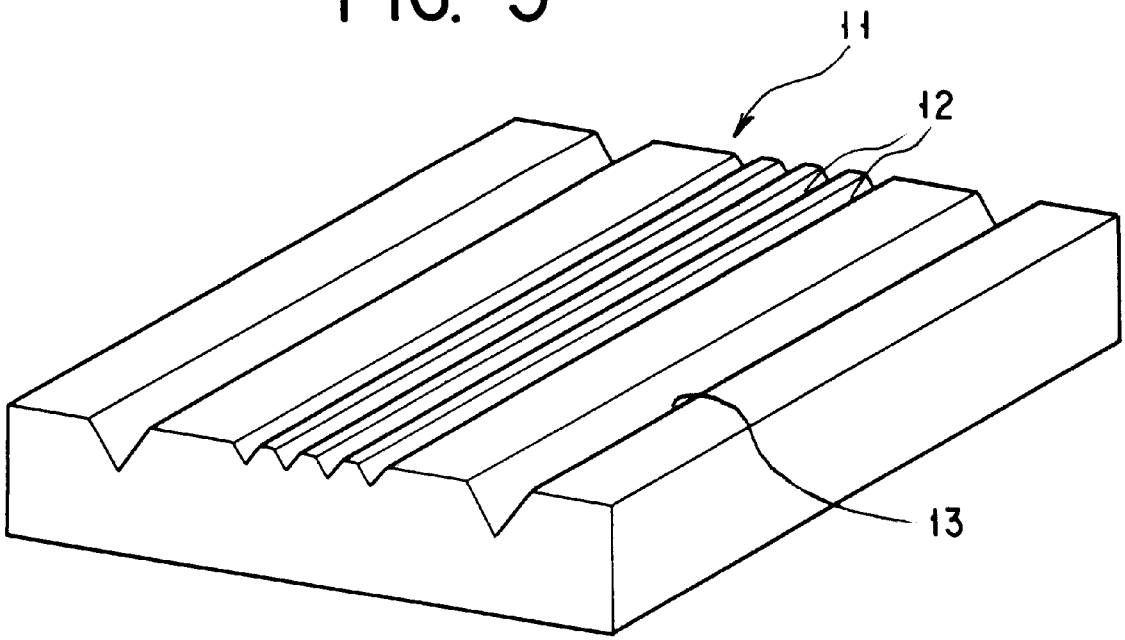
FIG. 5 is a perspective view illustrating one embodiment of a V-grooved substrate according to the present invention.
Figure 6:
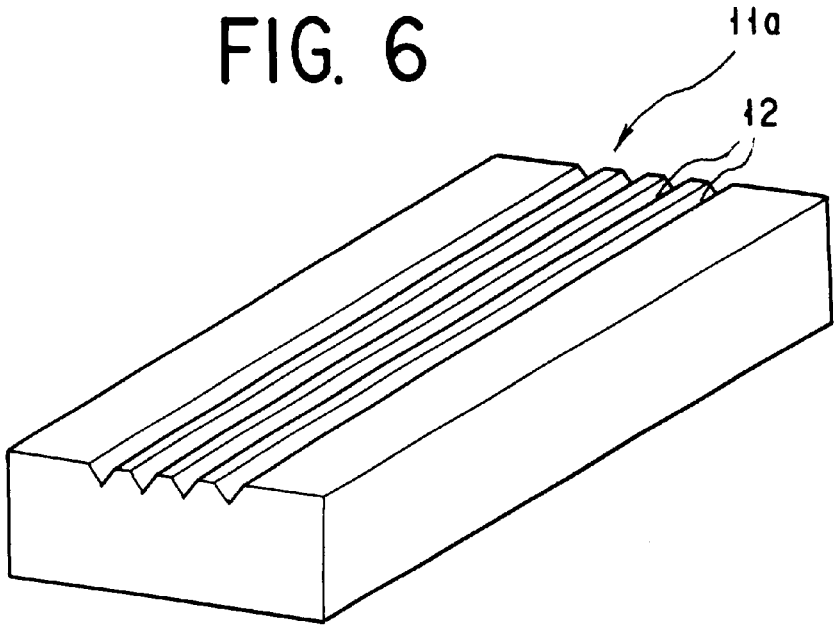
FIG. 6 is a perspective view illustrating another embodiment of the V-grooved substrate according to the present invention.

FIG. 5 illustrates the appearance of one embodiment of the V-grooved substrate according to the present invention. This V-grooved substrate 11 is provided at its upper face with four V-grooves 12 for optical fibers and two V-grooves 13 for guide pins. The V-grooves 12 are formed in the substrate parallel to each other and V-grooves 13 are formed on the opposite side of the V-grooves 12. This V-grooved substrate 11 is suitable for use in the multifiber optical connector mentioned above. FIG. 6 illustrates the appearance of another embodiment of the V-grooved substrate according to the present invention. This V-grooved substrate 11*a* is provided at its upper face with four V-grooves 12 for optical fibers which run parallel to each other.

Figure 7:
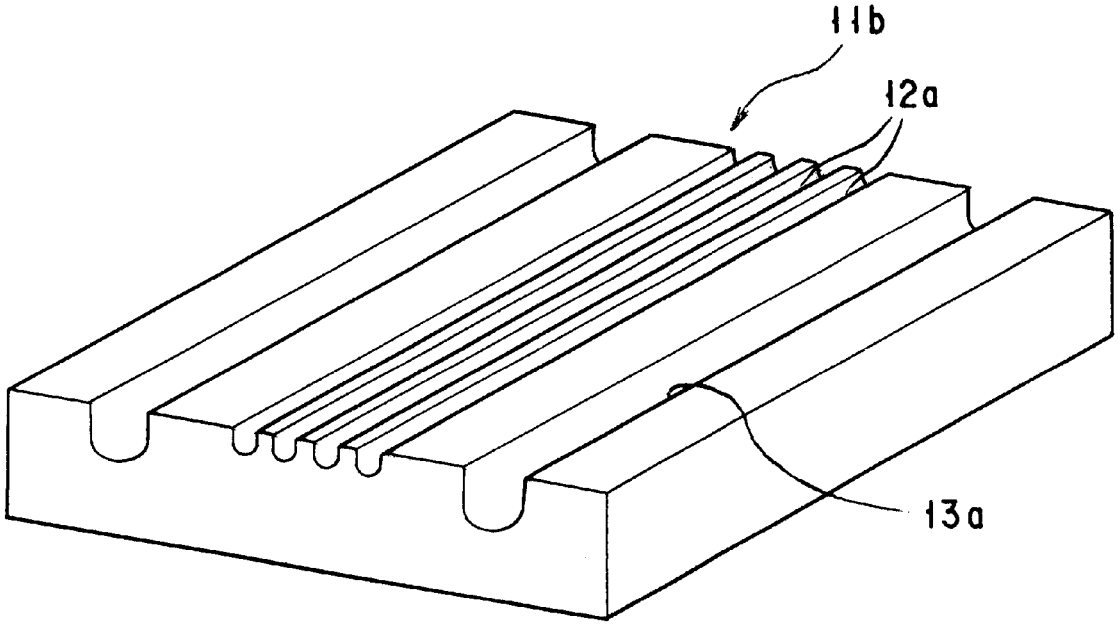
FIG. 7 is a perspective view illustrating one embodiment of a U-grooved substrate according to the present invention.
Figure 8:
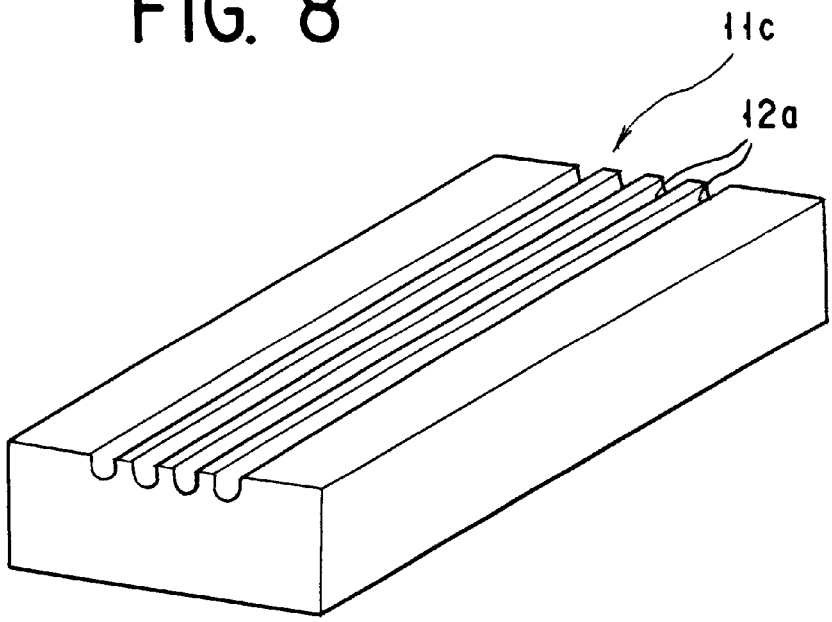
FIG. 8 is a perspective view illustrating another embodiment of the U-grooved substrate according to the present invention.

FIGS. 7 and 8 illustrate other two embodiments of the grooved substrate according to the present invention. Each of four grooves 12*a* for optical fibers and two grooves 13*a* for guide pins respectively formed in the upper face of the grooved substrate 11*b* as shown in FIG. 7 and four grooves 12*a* for optical fibers formed in the upper face of the grooved substrate 11*c* as shown in FIG. 8 has a cross-sectional contour of the letter U.

Incidentally, the grooves may have any other cross-sectional contours insofar as the optical fibers can be accurately positioned in the grooved substrate.

According to the first aspect of the present invention, the grooved substrates 11, 11*a*, 11*b*, and 11*c* are manufactured from an amorphous alloy as described above. The amorphous alloy manifests high tensile strength and high bending strength and excels in durability, resistance to impact, resistance to wear, surface smoothness, and other properties as compared with a wafer of silicon single crystal, alumina, and an epoxy resin, and, therefore, constitutes itself the optimum material for the grooved substrate. Particularly, it exhibits high hardness as compared with an epoxy resin. Since the grooved substrate which has been manufactured from the amorphous alloy possessed of such characteristic properties as described above does not easily sustain wear or microdeformation after the repetition of the attachment and detachment of the guide pins to and from the guide pin holes, the optical connector prepared by using this grooved substrate does not pose such problems as the increase of clearance between the guide pins and the holes therefor and the deterioration in the connector insertion loss.

Further, the amorphous alloy possesses highly accurate castability and machinability and, therefore, allows manufacture of a grooved substrate of smooth surface faithfully reproducing the contour of the cavity of the mold by the metal mold casting method or molding method. The grooved substrate made from a wafer of silicon single crystal or alumina must be ground to a prescribed size by all means as described above. In sharp contrast, since an amorphous alloy permits very faithful reproduction of the shape and size of a molding cavity of a metal mold by the casting process, the grooved substrate which satisfies dimensional prescription, dimensional accuracy, and surface quality, therefore, can be manufactured by a single process with high mass productivity insofar as the metal mold to be used is suitably prepared.

Although the material for the grooved substrate of the present invention does not need to be limited to any particular substance but may be any of the materials which are capable at all of furnishing a product formed substantially of amorphous alloy, the amorphous alloy having a composition represented by either one of the following general formulas (1) to (6) may be advantageously used.

$$M^1_aM^2_bLn_cM^3_dM^4_eM^5_f \quad (1)$$

wherein $M^1$ represents either or both of the two elements, Zr and Hf; $M^2$ represents at least one element selected from the group consisting of Ni, Cu, Fe, Co, Mn, Nb, Ti, V, Cr, Zn, Al, and Ga; Ln represents at least one element selected from the group consisting of Y, La, Ce, Nd, Sm, Gd, Tb, Dy, Ho, Yb, and Mm (mish metal: aggregate of rare earth elements); $M^3$ represents at least one element selected from the group consisting of Be, B, C, N, and O; $M^4$ represents at least one element selected from the group consisting of Ta, W, and MO; $M^5$ represents at least one element selected from the group consisting of Au, Pt, Pd, and Ag; and a, b, c, d, e, and f represent such atomic percentages as respectively satisfy $25 \leqq a \leqq 85, 15 \leqq b \leqq 75, 0 \leqq c \leqq 30, 0 \leqq d \leqq 30, 0 \leqq e \leqq 15$, and $0 \leqq f \leqq 15$.

The above amorphous alloy includes those represented by the following general formulas (1-a) to (1-p).

$$M^1_a M^2_b \quad (1\text{-a})$$

This amorphous alloy has large negative enthalpy of mixing and good producibility of the amorphous structure due to the coexistence of the $M^2$ element and Zr or Hf.

$$M^1_a M^2_b Ln_c \quad (1\text{-b})$$

The addition of a rare earth element to the above alloy, as in this amorphous alloy, enhances the thermal stability of the amorphous structure.

$$M^1_a M^2_b M^3_d \quad (1\text{-c})$$

$$M^1_a M^2_b Ln_c M^3_d \quad (1\text{-d})$$

The filling of gaps in the amorphous structure with an element having a small atomic radius (Be, B, C, N, or O), as in these amorphous alloys, makes the structure stable and enhances the producibility of the amorphous structure.

$$M^1_a M^2_b M^4_e \quad (1\text{-e})$$

$$M^1_a M^2_b Ln_c M^4_e \quad (1\text{-f})$$

$$M^1_a M^2_b M^3_d M^4_e \quad (1\text{-g})$$

$$M^1_a M^2_b Ln_c M^3_d M^4_e \quad (1\text{-h})$$

The addition of a high melting metal (Ta, W, or Mo) to the above alloys, as in these amorphous alloys, enhances the heat resistance and corrosion resistance without affecting the producibility of the amorphous structure.

$$M^1_a M^2_b M^5_f \quad (1\text{-i})$$

$$M^1_a M^2_b Ln_c M^5_f \quad (1\text{-j})$$

$$M^1_a M^2_b M^3_d M^5_f \quad (1\text{-k})$$

$$M^1_a M^2_b Ln_c M^3_d M^5_f \quad (1\text{-l})$$

$$M^1_a M^2_b M^4_e M^5_f \quad (1\text{-m})$$

$$M^1_a M^2_b Ln_c M^4_e M^5_f \quad (1\text{-n})$$

$$M^1_a M^2_b M^3_d M^4_e M^5_f \quad (1\text{-o})$$

$$M^1_a M^2_b Ln_c M^3_d M^4_e M^5_f \quad (1\text{-p})$$

These amorphous alloys containing a noble metal (Au, Pt, Pd, or Ag) will not be brittle even if the crystallization occurs.

$$Al_{100-g-h-i} Ln_g M^6_h M^3_i \quad (2)$$

wherein Ln represents at least one element selected from the group consisting of Y, La, Ce, Nd, Sm, Gd, Tb, Dy, Ho, Yb, and Mm; $M^6$ represents at least one element selected from the group consisting of Ti, V, Cr, Mn, Fe, Co, Ni, Cu, Zr, Nb, Mo, Hf, Ta, and W; $M^3$ represents at least one element selected from the group consisting of Be, B, C, N, and O; and g, h, and i represent such atomic percentages as respectively satisfy $30 \leqq g \leqq 90, 0 \leqq h \leqq 55$, and $0 \leqq i \leqq 10$.

The above amorphous alloy includes those represented by the following general formulas (2-a) and (2-b).

$$Al_{100-g-h} Ln_g M^6_h \quad (2\text{-a})$$

This amorphous alloy has large negative enthalpy of mixing and good producibility of the amorphous structure.

$$Al_{100-g-h-i} Ln_g M^6_h M^3_i \quad (2\text{-b})$$

This amorphous alloy has a stable structure and enhanced producibility of the amorphous structure due to the filling of gaps in the amorphous structure with an element having a small atomic radius (Be, B, C, N, or O).

$$Mg_{100-p} M^7_p \quad (3)$$

wherein $M^7$ represents at least one element selected from the group consisting of Cu, Ni, Sn, and Zn; and p represents an atomic percentage falling in the range of $5 \leqq p \leqq 60$.

This amorphous alloy has large negative enthalpy of mixing and good producibility of the amorphous structure.

$$Mg_{100-q-r} M^7_q M^8_r \quad (4)$$

wherein $M^7$ represents at least one element selected from the group consisting of Cu, Ni, Sn, and Zn; $M^8$ represents at least one element selected from the group consisting of Al, Si, and Ca; and q and r represent such atomic percentages as respectively satisfy $1 \leqq q \leqq 35$ and $1 \leqq r \leqq 25$.

The filling of gaps in the amorphous structure of the alloy of the above general formula (3) with an element having a small atomic radius (Al, Si, or Ca), as in this amorphous alloy, makes the structure stable and enhances the producibility of the amorphous structure.

$$Mg_{100-q-s} M^7_q M^9_s \quad (5)$$

$$Mg_{100-q-s} M^7_q M^8_r M^9_s \quad (6)$$

wherein $M^7$ represents at least one element selected from the group consisting of Cu, Ni, Sn, and Zn; $M^8$ represents at least one element selected from the group consisting of Al, Si, and Ca; $M^9$ represents at least one element selected from the group consisting of Y, La, Ce, Nd, Sm, and Mm; and q, r, and s represent such atomic percentages as respectively satisfy $1 \leqq q \leqq 35, 1 \leqq r \leqq 25$, and $3 \leqq s \leqq 25$.

The addition of a rare earth element to the alloy of the general formula (3) or (4) mentioned above, as in these amorphous alloys, enhances the thermal stability of the amorphous structure.

Among other amorphous alloys mentioned above, the Zr—TM—Al and Hf—TM—Al (TM: transition metal) amorphous alloys having very wide differences between the glass transition temperature (Tg) and the crystallization temperature (Tx) exhibit high strength and high corrosion resistance, possess wide supercooled liquid ranges (glass transition ranges), $\Delta Tx = Tx - Tg$, of not less than 30 K, and extremely wide supercooled liquid ranges of not less than 60 K in the case of the Zr—TM—Al amorphous alloys. In the above temperature ranges, these amorphous alloys manifest very satisfactory workability owing to viscous flow even at such low stress not more than some tens MPa. They are characterized by being produced easily and very stably as evinced by the fact that they are enabled to furnish an amorphous bulk material even by a casting method using a cooling rate of the order of some tens K/s. The aforementioned Zr—TM—Al and Hf—TM—Al amorphous alloys are disclosed in U.S. Pat. No. 5,032,196 issued Jul. 16, 1991 to Masumoto et al., the teachings of which are hereby incorporated by reference. After a further study in search of uses for these alloys, the inventor has ascertained that by the metal mold casting from melt and by the molding process utilizing the viscous flow resorting to the glass transition range as well, these alloys produce amorphous materials and permit very faithful reproduction of the shape and size of a molding cavity of a metal mold and, with the physical properties of the alloys as a contributory factor, befit the grooved substrate.

The Zr—TM—Al and Hf—TM—Al amorphous alloys to be used in the present invention possess very large range of ΔTx, though variable with the composition of alloy and the method of determination. The $Zr_{60}Al_{15}Co_{2.5}Ni_{7.5}Cu_{15}$ alloy (Tg: 652K, Tx: 768K), for example, has such an extremely wide ΔTx as 116 K. It also offers very satisfactory resistance to oxidation such that it is hardly oxidized even when it is heated in the air up to the high temperature of Tg. The Vickers hardness (Hv) of this alloy at temperatures from room temperature through the neighborhood of Tg is 460 (DPN), the tensile strength thereof is 1,600 MPa, and the bending strength thereof is up to 3,000 MPa. The thermal expansion coefficient, α of this alloy from room temperature through the neighborhood of Tg is as small as $1\times10^{-5}$/K, the Young's modulus thereof is 91 GPa, and the elastic limit thereof in a compressed state exceeds 4–5%. Further, the toughness of the alloy is high such that the Charpy impact value falls in the range of 6–7 J/cm$^2$. This alloy, while exhibiting such properties of very high strength as mentioned above, has the flow stress thereof lowered to the neighborhood of 10 MPa when it is heated up to the glass transition range thereof. This alloy, therefore, is characterized by being worked very easily and being manufactured with low stress into minute parts and high-precision parts complicated in shape. Moreover, owing to the properties of the so-called glass (amorphous) substance, this alloy is characterized by allowing manufacture of formed (deformed) articles with surfaces of extremely high smoothness and having substantially no possibility of forming a step which would arise when a slip band appeared on the surface as during the deformation of a crystalline alloy.

Generally, an amorphous alloy begins to crystallize when it is heated to the glass transition range thereof and retained therein for a long time. In contrast, the aforementioned alloys which possess such a wide ΔTx range as mentioned above enjoy a stable amorphous phase and, when kept at a temperature properly selected in the ΔTx range, avoid producing any crystal for a duration up to about two hours. The user of these alloys, therefore, does not need to feel any anxiety about the occurrence of crystallization during the standard molding process.

The aforementioned alloys manifest these properties unreservedly during the course of transformation thereof from the molten state to the solid state. Generally, the manufacture of an amorphous alloy requires rapid cooling. In contrast, the aforementioned alloys allow easy production of a bulk material of a single amorphous phase from a melt by the cooling which is effected at a rate of about 10 K/s. The solid bulk material consequently formed also has a very smooth surface. The alloys have transferability such that even a scratch of the order of microns inflicted by the polishing work on the surface of a metal mold is faithfully reproduced.

When the aforementioned alloys are adopted as the alloying material for the grooved substrate, therefore, the metal mold to be used for producing the formed article is only required to have the surface thereof adjusted to fulfill the surface quality expected of the grooved substrate because the molded product faithfully reproduces the surface quality of the metal mold. In the conventional metal mold casting method or molding method, therefore, these alloys allow the steps for adjusting the size and the surface roughness of the molded article to be omitted or diminished.

The characteristics of the aforementioned amorphous alloys including in combination relatively low hardness, high tensile strength, high bending strength, relatively low Young's modulus, high elastic limit, high impact resistance, smoothness of surface, and highly accurate castability or workability render these alloys appropriate for use as the material for the grooved substrate. They even allow these alloys to be molded for mass production by the conventional molding method.

Figure 9:
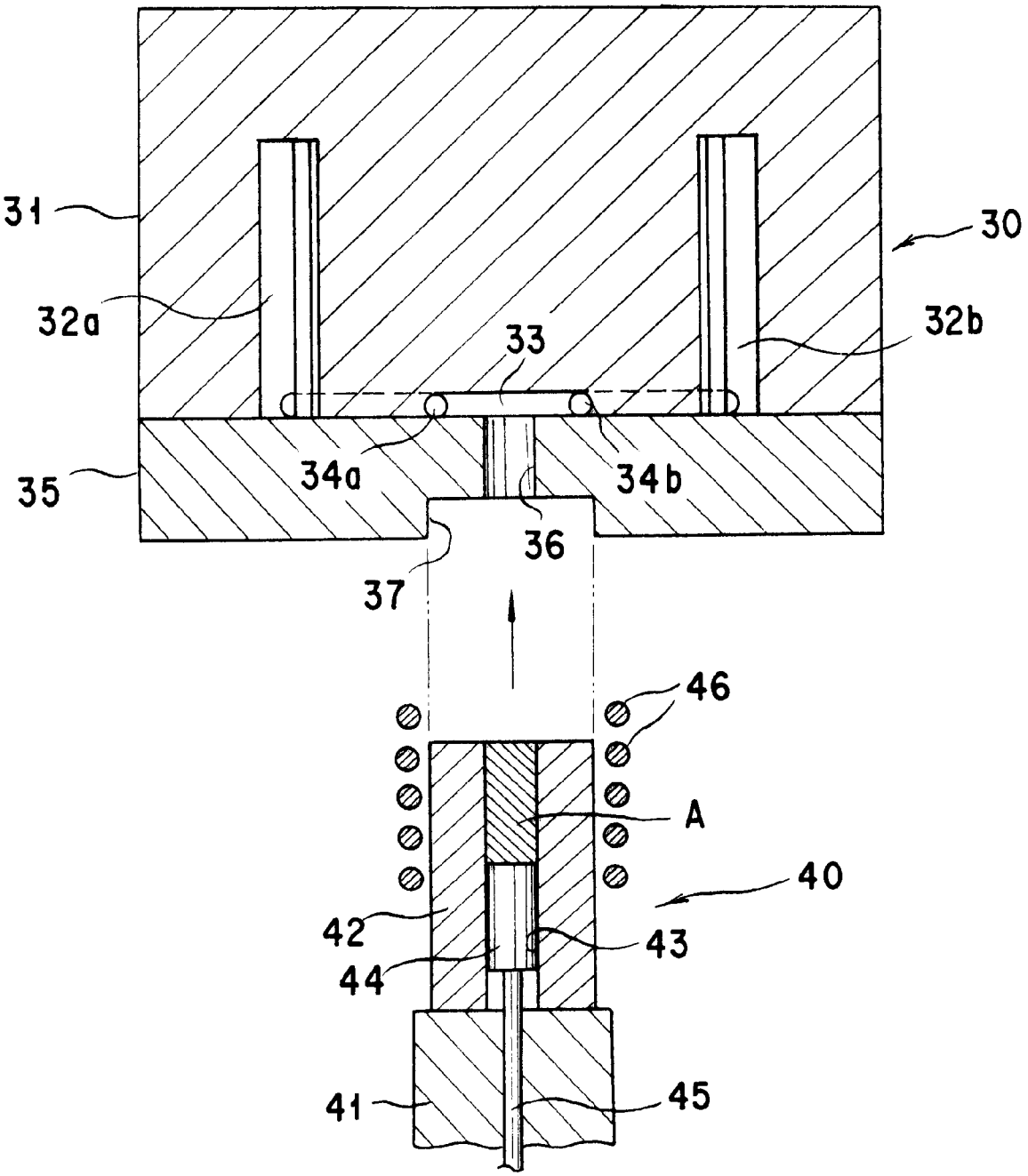
FIG. 9 is a fragmentary cross-sectional view schematically illustrating one embodiment of the apparatus to be used for the production of the V-grooved substrate of the present invention.

FIG. 9 schematically illustrates one mode of embodying an apparatus and method for the production of the V-grooved substrate of the present invention by the metal mold casting technique.

A forced cooling casting mold 30 is a split mold composed of an upper mold 31 and a lower mold 35. The upper mold 31 has a pair of molding cavities 32*a*, 32*b* formed therein and adapted to define the outside dimension of a V-grooved substrate. These cavities 32*a*, 32*b* intercommunicate through the medium of a runner 33 such that the molten metal flows through the leading ends of such parts 34*a*, 34*b* of the runner as half encircle the peripheries of the cavities 32*a*, 32*b* at a prescribed distance into the cavities 32*a*, 32*b*. On the other hand, a sprue (through-hole) 36 communicating with the runner 33 mentioned above is formed at a pertinent position of the lower mold 35. Underneath the sprue 36 is formed a depression 37 which is shaped to conform with a cylindrical raw material accommodating part or pot 42 constituting itself an upper part of a melting vessel 40.

While the forced cooling casting mold 30 can be made of such metallic material as copper, copper alloy, cemented carbide or superalloy, it is preferred to be made of such material as copper or copper alloy which has a large thermal capacity and high thermal conductivity for the purpose of heightening the cooling rate of the molten alloy poured into the cavities 32*a*, 32*b*. The upper mold 31 may have disposed therein such a flow channel as allow flow of a cooling medium like cooling water or cooling gas.

The melting vessel 40 is provided in the upper part of a main body 41 thereof with the cylindrical raw material accommodating part 42 and is disposed directly below the sprue 36 of the lower mold 35 in such a manner as to be reciprocated vertically. In a raw material accommodating hole 43 of the raw material accommodating part 42, a molten metal transferring member or piston 44 having nearly the same diameter as the raw material accommodating hole 43 is slidably disposed. The molten metal transferring member 44 is vertically moved by a plunger 45 of a hydraulic cylinder (or pneumatic cylinder) not shown in the diagram. An induction coil 46 as a heat source is disposed so as to encircle the raw material accommodating part 42 of the melting vessel 40. As the heat source, any arbitrary means such as one resorting to the phenomenon of resistance heating may be adopted besides the high-frequency induction heating. The material of the raw material accommodating part 42 and that of the molten metal transferring member 44 are preferred to be such heat-resistant material as ceramics or metallic materials coated with a heat-resistant film.

Incidentally, for the purpose of preventing the molten alloy from forming an oxide film, it is preferred to dispose the apparatus in its entirety in a vacuum or an atmosphere of an inert gas such as Ar gas or establish a stream of an inert gas at least between the lower mold 35 and the upper part of the raw material accommodating part 42 of the melting vessel 40.

The production of the V-grooved substrate of the present invention is effected by first setting the melting vessel 40 in a state separated downwardly from the forced cooling casting mold 30 and then charging the empty space overlying the molten metal transferring member 44 inside the raw material accommodating part 42 with the alloying raw material "A" of a composition capable of yielding such an amorphous alloy as mentioned above. The alloying raw material "A" to be used may be in any of the popular forms such as rods, pellets, and minute particles.

Subsequently, the induction coil 46 is excited to heat the alloying raw material "A" rapidly. After the fusion of the alloying raw material "A" has been confirmed by detecting the temperature of the molten metal, the induction coil 46 is demagnetized and the melting vessel 40 is elevated until the upper end thereof is inserted in the depression 37 of the lower mold 35. Then, the hydraulic cylinder is actuated to effect rapid elevation of the molten metal transferring member 44 through the medium of the plunger 45 and injection of the molten metal through the sprue 36 of the casting mold 30. The injected molten metal is advanced through the runner 33 introduced into the cavities 32*a*, 32*b* and compressed and rapidly solidified therein. In this case, the cooling rate exceeding $10^3$ K/s can be obtained by suitably setting such factors as injection temperature and injection speed, for example. Thereafter, the melting vessel 40 is lowered and the upper mold 31 and the lower mold 35 are separated to allow extraction of the product.

Figure 10:
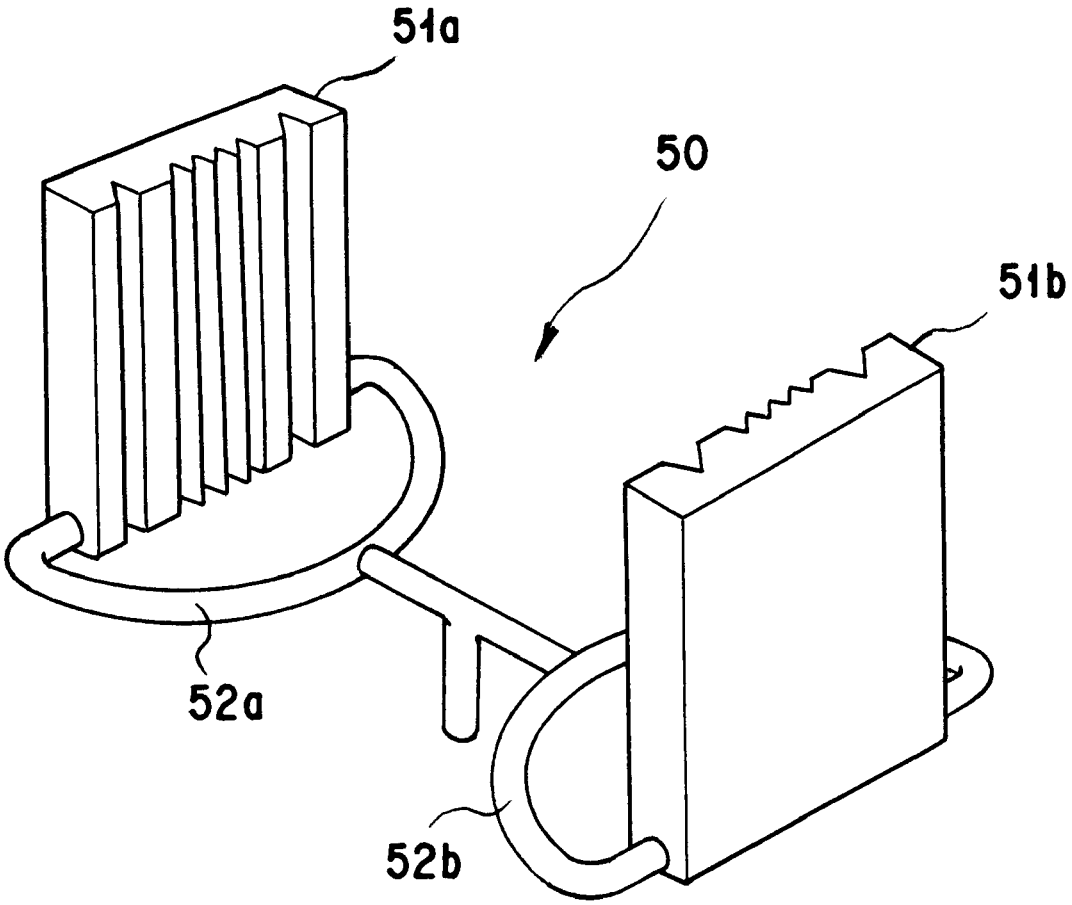
FIG. 10 is a perspective view of a cast article manufactured by the apparatus shown in FIG. 9.

The shape of the cast product manufactured by the method described above is illustrated in FIG. 10. The V-grooved substrates 11 possessed of a smooth surface faithfully reproducing the cavity surface of the casting mold as illustrated in FIG. 5 are obtained by severing runner parts 52*a*, 52*b* from V-grooved substrate parts 51*a*, 51*b* of a cast product 50 and grinding the cut faces of the V-grooved substrate parts remaining after by the severance.

The high-pressure die casting method described above allows a casting pressure up to about 100 MPa and an injection speed up to about several m/s and enjoys the following advantages.

(1) The charging of the mold with the molten metal completes within several milliseconds and this quick charging adds greatly to the action of rapid cooling.

(2) The highly close contact of the molten metal to the mold adds to the speed of cooling and allows precision molding of molten metal as well.

(3) Such faults as shrinkage cavities possibly occurring during the shrinkage of a cast article due to solidification can be allayed.

(4) The method allows manufacture of a formed article in a complicated shape.

(5) The method permits smooth casting of a highly viscous molten metal.

Figure 11:
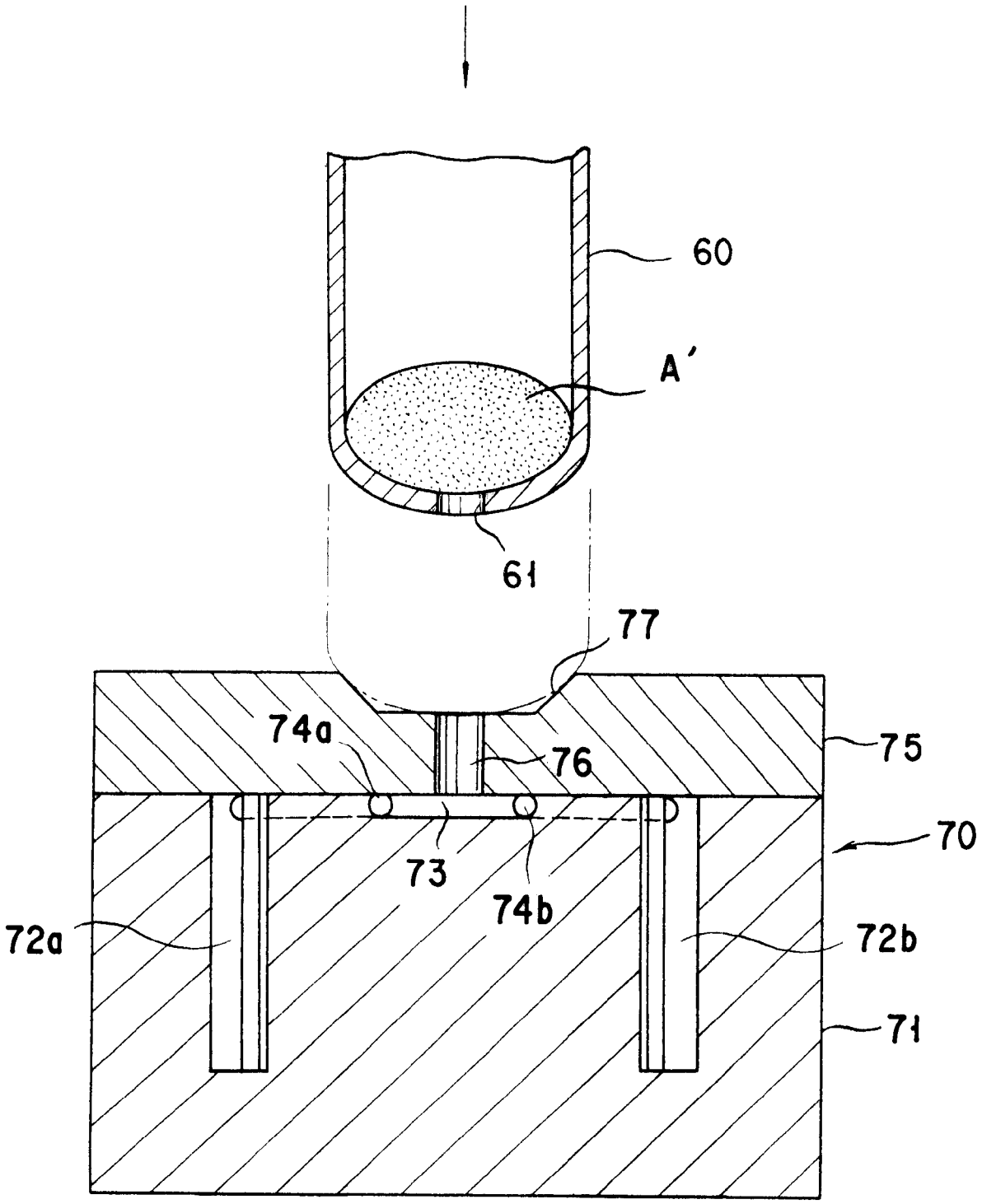
FIG. 11 is a fragmentary cross-sectional view schematically illustrating another embodiment of the apparatus to be used for the production of the V-grooved substrate of the present invention.

FIG. 11 illustrates schematically the construction of another mode of embodying the apparatus and method for producing the V-grooved substrate of the present invention.

In FIG. 11, the reference numeral 60 denotes a vessel for melting an alloying material capable of producing such an amorphous alloy as mentioned above and holding the produced melt therein. Beneath this vessel 60 is disposed a split metal mold 70 having cavities 72*a*, 72*b* of the shape of a product aimed at. Any of such known heating means (not shown) as, for example, the high-frequency induction heating and the resistance heating may be adopted for heating the vessel 60.

The construction of the metal mold 70 is substantially identical with the mold 30 illustrated in FIG. 9 mentioned above except that the vertical positional relation is reversed. Specifically, an upper mold 75 has formed in the upper part of a sprue (through-hole) 76 a depression 77 for accommodating the lower end part of the vessel 60 and corresponds to the lower mold 35 shown in FIG. 9. Meanwhile, a lower mold 71 is identical with the upper mold 31 shown in FIG. 9 except that molding cavities 72*a*, 72*b* and runners 73, 74*a*, 74*b* have their shapes and modes of disposition reversed from those of FIG. 9.

The production of V-grooved substrates are carried out by connecting a small hole 61 formed in the bottom part of the vessel 60 to the sprue 76 of the metal mold 70, applying pressure to the molten alloy A' in the vessel 60 through the medium of inert gas thereby forwarding the molten alloy A' from the small hole 61 in the bottom of the vessel 60 through the runners 73, 74*a*, and 74*b* into the cavities 72*a*, 72*b* until these cavities are filled with the molten alloy A' to capacity, and solidifying the molten alloy at a cooling rate preferably exceeding 10 K/s to obtain the V-grooved substrate made of an alloy consisting substantially of an amorphous phase.

By the procedure just described, the V-grooved substrate can be produced which manifests a dimensional accuracy, L, in the range of ±0.5 $\mu$m and a surface accuracy in the range of 0.2 to 0.4 $\mu$m.

The method, as described above, manufactures two cast products by a single process using a metal mold provided with a pair of molding cavities. Naturally, the present invention can manufacture three or more cast products by using a metal mold provided with three or more cavities therein. The present invention is not limited to the embodiment mentioned above with respect to the size, shape, and number of V-grooves of the V-grooved substrate. The U-grooved substrates as illustrated in FIGS. 7 and 8 may also be manufactured by the aforementioned apparatus with slightly modifying the contours of the cavities of the metal mold. Since this modification will be obvious to a person skilled in the art, the illustration thereof is omitted. Furthermore, the present invention is not limited to the grooved substrates for use in the multifiber optical connectors and for aligning the multiple optical fibers. For instance, a single mode optical connector may be manufactured in the same way as mentioned above.

Besides the alloy casting method described above, the extrusion molding is also available for the manufacture of the grooved substrate. Since the amorphous alloy mentioned above possesses a large supercooled liquid region $\Delta Tx$, the grooved substrate can be obtained in a prescribed shape by heating a material of this amorphous alloy to a temperature in the supercooled liquid region, inserting the hot material in a container retained at the same temperature, connecting this container to the metal mold provided with the cavity of the shape of a grooved substrate product aimed at, pressing a prescribed amount of the heated alloy into the cavity by virtue of the viscous flow of the supercooled liquid, and molding the alloy.

Now, the present invention will be described more concretely below with reference to working examples which have demonstrated the effect of the present invention specifically.

EXAMPLE 1

By using the apparatus shown in FIG. 9 and an amorphous alloy having a composition of $Zr_{65}Al_{10}Ni_{10}Cu_{15}$ and employing the production conditions of an injection temperature of 1273 K, injection speed of 1 m/s, casting pressure of 10 MPa, and loading time of 100 milliseconds, a V-grooved substrate (pitch of V-grooves: 0.25 mm, for four optical fibers of diameter 0.125 mm) of the shape (width: 6.4 mm, thickness: 1.2 mm, and length: 8 mm) shown in FIG. 5 was manufactured.

The V-grooved substrate obtained was a product having an outstanding surface smoothness faithfully reproducing the contour of the cavity of the metal mold. It was found to manifest a Young's modulus of 80 GPa, bending strength of 2,970 MPa, Vickers hardness of 400 (DPN), and a thermal expansion coefficient, $\alpha$, of $0.95\times10^{-5}$/K. A multifiber optical connector prepared by using the V-grooved substrate obtained as described above was subjected to the attachment and detachment test of 500 cycles with guide pins. A powder caused by wear was not observed in the peripheries of the holes and the guide pins. The connector insertion loss obtained after the attachment and detachment test of 500 cycles satisfied the specified value of not more than 0.5 dB, without mentioning the value obtained before the test.

EXAMPLE 2

A metal mold of steel as illustrated in FIG. 9 and a metallic extruder were connected and a V-grooved substrate was manufactured by extruding the same alloy as used in Example 1. For the extrusion, amorphous billets, 25 mm in diameter and 40 mm in length, of the same alloy prepared separately by casting were used. The billets were preheated to 730 K and the container of the extruder and the inlet part and the molding part of the metal mold were similarly preheated to 730 K. The hot billets were inserted into the container of the extruder and then injected into the metal mold. The metal mold was cooled. Then the formed article was removed from the mold, deprived of the inlet part, and inspected. The outward appearance, the dimensional accuracy, the surface roughness, etc. of the formed article were found to be nearly equal to those of the V-grooved substrate obtained in Example 1. The performance of the optical connector prepared by using the V-grooved substrate satisfied the specified value, as in the case of Example 1, after the attachment and detachment test of 500 cycles of guide pins.

EXAMPLE 3

By using the apparatus shown in FIG. 9 and an amorphous alloy having a composition of $La_{55}Al_{25}Ni_{10}Cu_{10}$ and employing the production conditions of an injection temperature of 1073 K, injection speed of 1 m/s, casting pressure of 10 MPa, and loading time of 100 milliseconds, a V-grooved substrate of the shape shown in FIG. 5 was manufactured.

The V-grooved substrate obtained was a product having an outstanding surface smoothness faithfully reproducing the contour of the cavity of the metal mold. It was found to manifest a Young's modulus of 20 GPa, bending strength of 1,100 MPa, Vickers hardness of 240 (DPN), and a thermal expansion coefficient, $\alpha$, of $0.7\times10^{-5}$/K. A multifiber optical connector prepared by using the V-grooved substrate obtained as described above was subjected to the attachment and detachment test of 500 cycles with guide pins. A powder caused by wear was not observed in the peripheries of the holes and the guide pins. The connector insertion loss obtained after the attachment and detachment test of 500 cycles satisfied the specified value of not more than 0.5 dB, without mentioning the value obtained before the test.

EXAMPLE 4

A metal mold of copper as illustrated in FIG. 9 and a metallic extruder were connected and a V-grooved substrate was manufactured by extruding the same alloy as used in Example 3. For the extrusion, amorphous billets of the same alloy prepared separately by casting were used. The billets were preheated to 473 K and the container of the extruder and the inlet part and the molding part of the metal mold were similarly preheated to 473 K. The hot billets were inserted into the container of the extruder and then injected into the metal mold. The metal mold was cooled. Then the formed article was removed from the mold, deprived of the inlet part, and inspected. The outward appearance, the dimensional accuracy, the surface roughness, etc. of the formed article were found to be nearly equal to those of the V-grooved substrate obtained in Example 3. The performance of the connector prepared by using the V-grooved substrate satisfied the specified value, as in the case of Example 3, after the attachment and detachment test of 500 cycles of guide pins.

EXAMPLE 5

By using the apparatus shown in FIG. 9 and an amorphous alloy having a composition of $Mg_{75}Cu_{15}Y_{10}$ and employing the production conditions of an injection temperature of 1073 K, injection speed of 1 m/s, casting pressure of 10 MPa, and loading time of 100 milliseconds, a V-grooved substrate of the shape shown in FIG. 5 was manufactured.

The V-grooved substrate obtained was a product having an outstanding surface smoothness faithfully reproducing the contour of the cavity of the metal mold. It was found to manifest a Young's modulus of 47 GPa, bending strength of 1,080 MPa, and Vickers hardness of 250 (DPN). A multifiber optical connector prepared by using the V-grooved substrate obtained as described above was subjected to the attachment and detachment test of 500 cycles with guide pins. A powder caused by wear was not observed in the peripheries of the holes and the guide pins. The connector insertion loss obtained after the attachment and detachment test of 500 cycles satisfied the specified value of not more than 0.5 dB, without mentioning the value obtained before the test.

EXAMPLE 6

A metal mold of copper as illustrated in FIG. 9 and a metallic extruder were connected and a V-grooved substrate was manufactured by extruding the same alloy as used in Example 5. For the extrusion, amorphous billets of the same alloy prepared separately by casting were used. The billets were preheated to 450 K and the container of the extruder and the inlet part and the molding part of the metal mold were similarly preheated to 450 K. The hot billets were inserted into the container of the extruder and then injected into the metal mold. The metal mold was cooled. Then the formed article was removed from the mold, deprived of the inlet part, and inspected. The outward appearance, the dimensional accuracy, the surface roughness, etc. of the formed article were found to be nearly equal to those of the V-grooved substrate obtained in Example 3. The performance of the connector prepared by using the V-grooved substrate satisfied the specified value, as in the case of Example 5, after the attachment and detachment test of 500 cycles of guide pins.

While certain specific embodiments and working examples have been disclosed herein, the invention may be embodied in other specific forms without departing from the spirit or essential characteristics thereof. The described embodiments and examples are therefore to be considered in all respects as illustrative and not restrictive, the scope of the invention being indicated by the appended claims rather than by the foregoing description and all changes which come within the meaning and range of equivalency of the claims are, therefore, intended to be embraced therein.

The disclosure in Japanese Patent Application No. 11-125593 of May 6, 1999 is incorporated here by reference. This Japanese Patent Application describes the invention described hereinabove and claimed in the claims appended hereinbelow and provides the basis for a claim of priority for the instant invention under 35 U.S.C. 119.

What is claimed is:

1. A grooved substrate for a multifiber optical connector including optical fiber receiving grooves and either guide pins or guide pin receiving grooves, wherein each of the grooves is formed on one surface of the substrate for aligning or positioning optical fibers, and wherein said substrate is made of a zirconium base amorphous alloy possessing at least a glass transition region.

2. The grooved substrate according to claim 1, wherein said glass transition region has a temperature width of not less than 30 K.

3. The grooved substrate according to claim 1, wherein said substrate is provided with grooves each having a cross-sectional contour of the letter V.

4. The grooved substrate according to claim 1, wherein said substrate is provided with grooves each having a cross-sectional contour of the letter U.

5. A V-grooved substrate for a multifiber optical connector including optical fiber receiving grooves and either guide pins or guide pin receiving grooves, wherein each of the grooves is V-shaped and is formed on one surface of the substrate for aligning or positioning optical fibers, and wherein said substrate is made of a zirconium base amorphous alloy possessing at least a glass transition region.

6. The V-grooved substrate according to claim 5, wherein said glass transition region has a temperature width of not less than 30 K.

7. A grooved substrate for a multifiber optical connector including optical fiber receiving grooves and either guide pins or guide pin receiving grooves, wherein each of the grooves is formed on one surface of the substrate for aligning or positioning optical fibers, and wherein said substrate is made of a substantially amorphous alloy having a composition represented by the following general formula (1) and containing an amorphous phase in a volumetric ratio of at least 50%:

$$M^1{}_aM^2{}_bLn_cM^3{}_dM^4{}_eM^5{}_f \quad (1)$$

wherein $M^1$ represents Zr; $M^2$ represents at least one element selected from the group consisting of Ni, Cu, Fe, Co, Mn, Nb, Ti, V, Cr, Zn, Al, and Ga; Ln represents at least one element selected from the group consisting of Y, La, Ce, Nd, Sm, Gd, Tb, Dy, Ho, Yb, and Mm (mish metal: aggregate of rare earth elements); $M^3$ represents at least one element selected from the group consisting of Be, B, C, N, and O; $M^4$ represents at least one element selected from the group consisting of Ta, W, and Mo; $M^5$ represents at least one element selected from the group consisting of Au, Pt, Pd, and Ag; and a, b, c, d, e, and f represent such atomic percentages as respectively satisfy $25 \leqq a \leqq 85, 15 \leqq b \leqq 75$, $0 \leqq c \leqq 30$, $0 \leqq d \leqq 30, 0 \leqq e \leqq 15$, and $0 \leqq f \leqq 15$.

8. The grooved substrate according to claim 7, wherein said substrate is provided with grooves each having a cross-sectional contour of the letter V.

9. The grooved substrate according to claim 7, wherein said substrate is provided with grooves each having a cross-sectional contour of the letter U.

* * * * *